United States Patent [19]

Mast et al.

[11] Patent Number: 4,576,519

[45] Date of Patent: Mar. 18, 1986

[54] OFFSHORE PLATFORM BASE

[75] Inventors: Robert F. Mast, Auburn; William J. Cichanski, Tacoma; Francis R. Walker, Federal Way, all of Wash.; Donald D. Magura, Vancouver, Canada

[73] Assignee: Exxon Production Research Co., Houston, Tex.

[21] Appl. No.: 497,389

[22] Filed: May 23, 1983

[51] Int. Cl.[4] ..... E02B 17/00

[52] U.S. Cl. ..... 405/207; 405/217

[58] Field of Search ..... 405/195, 203–205, 405/207, 208, 210, 211, 217, 224, 227, 229; 114/65 A, 65 R, 74 R, 78, 125, 266, 267

[56] References Cited

U.S. PATENT DOCUMENTS

| | | | |
|---|---|---|---|
| 2,906,100 | 9/1959 | Long et al. . | |
| 3,343,324 | 9/1967 | Gordon . | |
| 3,456,720 | 7/1969 | Brewer . | |
| 3,466,878 | 9/1969 | Esquillan et al. . | |
| 3,510,892 | 5/1970 | Monnereau et al. . | |
| 3,879,952 | 4/1975 | Mo . | |
| 3,886,753 | 6/1975 | Birdy et al. . | |
| 3,911,687 | 10/1975 | Mo . | |
| 3,951,085 | 4/1976 | Johnson et al. . | |
| 3,961,489 | 6/1976 | Mo . | |
| 3,977,346 | 8/1976 | Natvig et al. . | |
| 3,999,395 | 12/1976 | Broms et al. | 405/224 X |
| 3,999,396 | 12/1976 | Evans . | |
| 4,003,327 | 1/1977 | Finsterwalder . | |
| 4,011,826 | 3/1977 | Yee . | |
| 4,045,968 | 9/1977 | Gerwick, Jr. . | |
| 4,056,943 | 11/1977 | Tarrant . | |
| 4,080,795 | 3/1978 | Weidler, Jr. . | |
| 4,188,157 | 2/1980 | Vigander . | |
| 4,202,648 | 5/1980 | Kvamsdal . | |
| 4,302,291 | 11/1981 | Severs et al. . | |
| 4,303,352 | 12/1981 | Marion . | |
| 4,304,506 | 12/1981 | Olsen . | |
| 4,372,705 | 2/1983 | Atkinson . | |
| 4,437,794 | 3/1984 | Grimsley et al. | 405/203 X |
| 4,448,570 | 5/1984 | Berthin | 905/207 X |
| 4,478,537 | 10/1984 | Birdy et al. | 405/203 X |

FOREIGN PATENT DOCUMENTS

| | | | |
|---|---|---|---|
| 843339 | 8/1960 | United Kingdom | 405/205 |
| 2018700 | 10/1979 | United Kingdom | 405/205 |

OTHER PUBLICATIONS

"Mathematical Models", by H. Martyn Cundy and A. P. Rollett, Second Edition, Oxford University Press ©1961, pp. 59–65.

"Space Grid Structures: Skeletal Frameworks and Stressed-Skin Systems", by John Borrego, Massachusetts Institute of Technology, ©1968, pp. 193–195.

*Primary Examiner*—Cornelius J. Husar

*Assistant Examiner*—Nancy J. Stodola

*Attorney, Agent, or Firm*—Marc L. Delflache; Richard F. Phillips

[57] ABSTRACT

An improved offshore platform base (12) is disclosed having three sets of substantially parallel bulkheads (24, 26, 28) which intersect one another at about 120° forming a repeatable array of contiguous triangular (30) and hexagonal-shaped (34) chambers.

3 Claims, 6 Drawing Figures

OFFSHORE PLATFORM BASE

BACKGROUND OF THE INVENTION

1. Field of the Invention

This invention relates to an improved offshore platform base. More particularly, this invention relates to an improved structural bulkhead configuration for the base of an offshore platform.

2. Description of the Prior Art

As the exploration and production of petroleum and natural gas extends into deeper waters and more remote locations, a need exists for improved offshore platforms capable of withstanding severe environmental conditions.

Typically, once the exploration of an offshore oil or gas well is completed, a production platform is installed which is either fixed to the ocean floor by piles or rests on the ocean floor. With respect to the latter type of platform (also referred to herein as a gravity structure), the structural integrity of the base portion of the platform is critical to its overall stability. This is particularly the case in an arctic environment because continuously moving ice masses pose a serious threat to the operation of the platform. Even in an ice-free area, wave and current loads, particularly during storms, can be very significant.

A number of base configurations for offshore structures have been developed. Three such configurations include radial-oriented bulkheads, circular-oriented bulkheads and rectangular-oriented bulkheads. U.S. Pat. Nos. 4,045,968 and 4,303,352 illustrate the radial-oriented design. U.S. Pat. Nos. 3,879,952; 3,911,687; 3,961,489; 4,188,157; and 4,304,506 show the circular-oriented bulkheads. U.S. Pat. No. 3,886,753 shows a rectangular-oriented bulkhead configuration. However, each of these configurations have certain disadvantages in view of the many factors which must be considered in designing a new configuration.

Primarily, the structural bulkheads must be capable of withstanding the lateral and vertical loads which will be exerted on the platform. As mentioned above, these loads are significant, particularly in an arctic environment. In addition, the base configuration must be capable of withstanding installation loads. The base must also be able to resist hogging and sagging moments and torsion or twisting during transportation to the final location. Hogging is the straining of a vessel such that the bow and stern are lower than the midship line. Sagging is when the midship line is lower than the bow and stern.

Since the base is typically floated to location, weight is a critical factor. The base for a gravity structure must be capable of retaining various types of ballast materials and, similarly, capable of withstanding loads associated with these ballast materials, particularly the differential pressures between the ballast and the hydrostatic loads, and conditions where no ballast is present.

Industry recognizes a need for an improved base design which will maximize structural integrity both from an installation and an operational standpoint yet minimize weight for transportation and cost reasons.

SUMMARY OF THE INVENTION

Recognizing the need for an improved offshore platform base, the present invention is directed to an improved structural bulkhead configuration.

The improved base includes a bottom plate capable of contacting the ocean floor and three sets of continuous, substantially parallel bulkheads which are attached to the bottom plate. Each set of bulkheads intersects the other two sets at an angle of about 120°. All the bulkheads are continuous thereby permitting an even distributions of the loads throughout the base. The three sets of bulkheads intersect one another so that a substantially repeatable grid pattern occurs comprising adjacent triangular and hexagonal-shaped chambers.

The base also includes a top plate which contacts the top edge of the bulkheads and a perimeter wall which is attached to the outer edges of the top and bottom plate and circumscribes the three sets of bulkheads.

BRIEF DESCRIPTION OF THE DRAWINGS

In the drawings, wherein like reference numerals indicate like parts and wherein illustrated embodiments of this invention are shown.

DETAILED DESCRIPTION OF THE INVENTION

Figure 1:
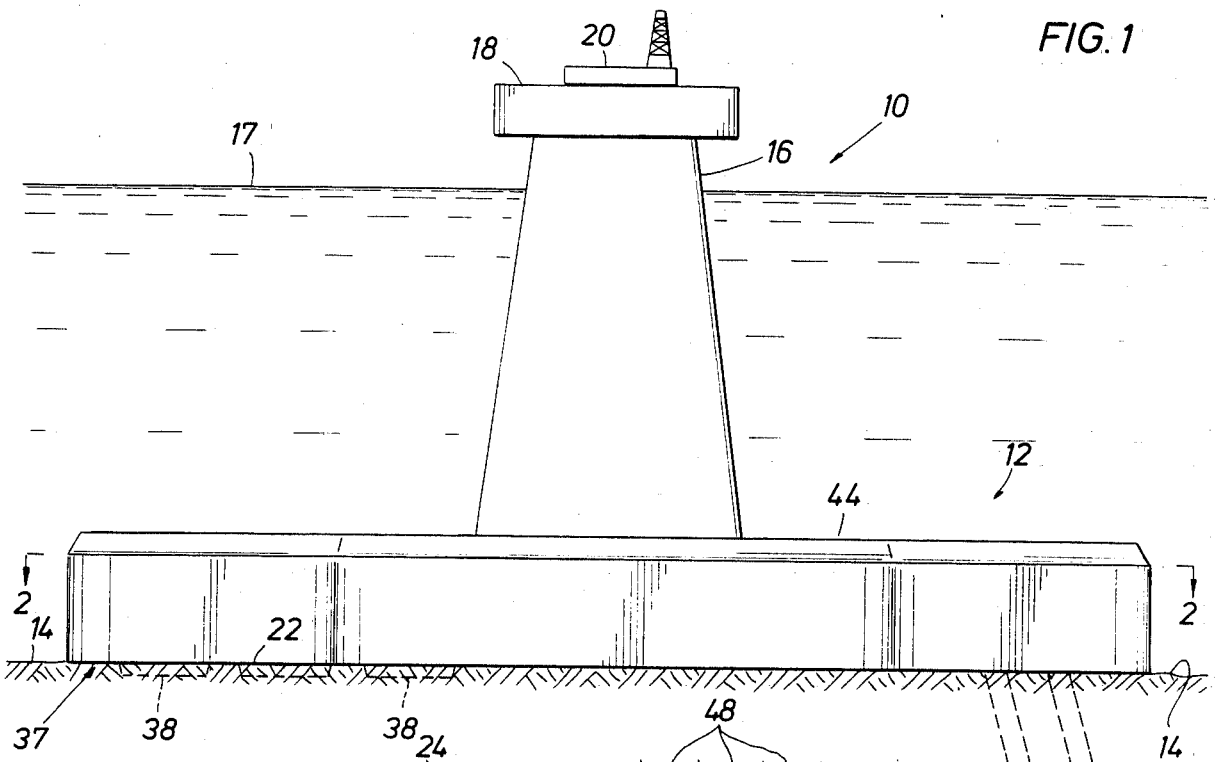
FIG. 1 is an elevation view of an offshore platform.

FIG. 1 shows an elevation view of an offshore plateform 10 having a base 12 contacting the ocean floor 14, a leg or supporting column 16 extending from the base to a point above the water surface 17, and a deck 18 supported by the column 16 on which equipment 20 used for the exploration and/or production of oil or gas is located. The base includes a bottom plate 22 which contacts the ocean floor.

Referring to FIGS. 2 and 3A–3C, the base 18 also includes a first set of continuous, substantially parallel bulkheads 24 which are attached along one edge 25 to the bottom plate 22. The base also includes a second set of continuous, substantially parallel bulkheads 26 which are also attached along one edge 27 the bottom plate and which intersect the first set of bulkheads 24 at an angle of approximately 120° (angle $\alpha$). The base furthermore includes a third set of continuous, substantially parallel bulkheads 28 attached at one of their edges 29 to the bottom plate and also intersecting the first and second set of bulkheads 24, 26 at an angle of about 120°. The term "continuous" as used herein with respect to the bulkhead means that a bulkhead extends from one side of the base to the other side without substantial interruption or discontinuity. The intersection of two bulkheads is not a substantial interruption in their continuity. Indeed, as explained below, this intersection is critical to the stability of the base.

Figure 2:
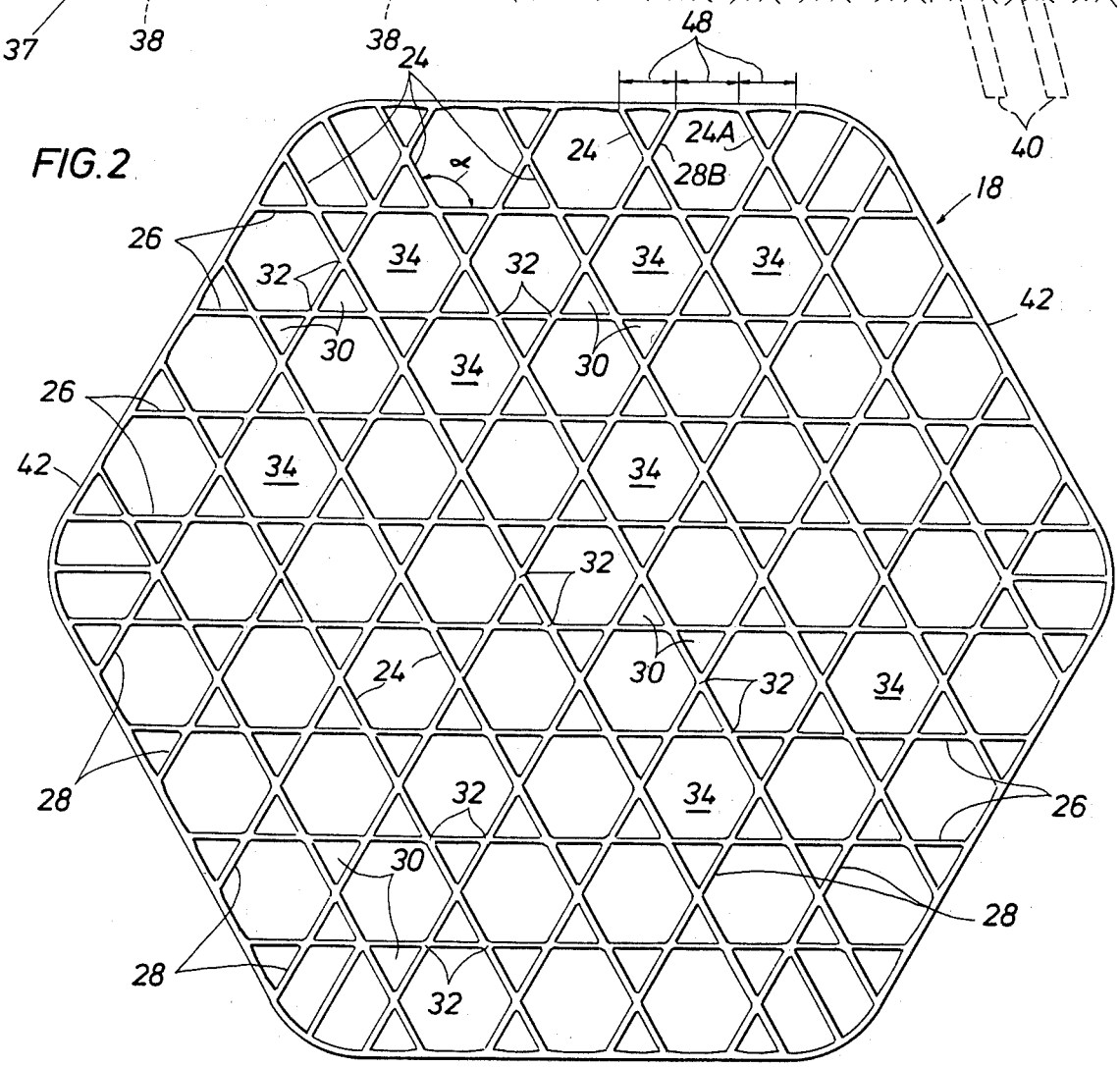
FIG. 2 is a cross-sectional plan view of a base of the offshore platform taken along line 2—2 of FIG. 1.
Figure 3A:
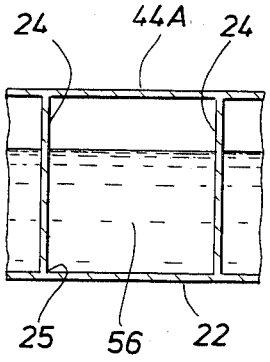
FIGS. 3A, 3B, and 3C are cross-sectional horizontal views of various chambers of the base containing ballast materials.
Figure 3B:
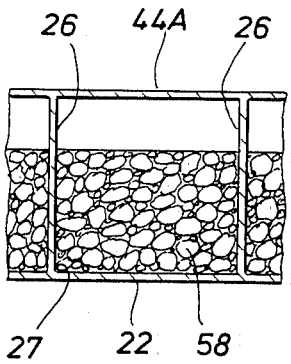
Figure 3C:
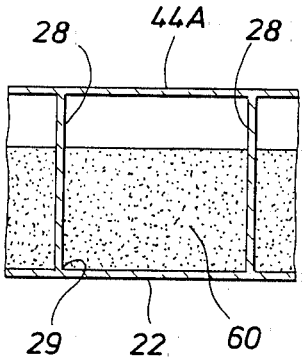

As illustrated in FIG. 2, the intersecting sets of bulkheads form an array or grid pattern of triangular chambers 30, which are adjacent to one another at their apexes 32, and hexagonal chambers 34. Each hexagonal chamber is adjacent to a triangular chamber and touches adjacent hexagonal chambers at its corners which are also the apexes 32 for the triangular chamber 30.

Intersecting angles of 120° (with a complement of 60°) permit a more uniform load distribution within the base 18. This is, the cosine of 60° is 0.5. By reducing a load by 50% at each intersection of the bulkhead, the load is disseminated uniformly and quickly throughout the base. Accordingly, the present invention requires a minimum cross-sectional area of material for the bulkheads since the cross-sectional area of a bulkhead is directly related to the anticipated design loads. And, the weight (hence cost) is reduced since weight is directly related to cross-sectional area. Continuous bulkheads also permit efficient use of prestressed concrete materials which further optimizes a weight savings.

From the base, the loads are transferred to the foundation area 37 which may compose a series of shear plates 38 or piles 40, if it is a fixed structure. Once distributed to these foundational members, the load is then quickly disseminated into the ocean floor.

The base also includes a perimeter wall 42 which is attached to the bottom plate 22 and to the ends of the three sets of bulkheads 24, 26, 28. Furthermore, the base includes a top plate 44 (see FIG. 1) which contacts the perimeter wall. The top plate may be one continuous plate, or it may be a series of plates 44A which are removably attached to the tops of the bulkheads over one or more triangular and/or hexagonal-shaped chambers.

With the overall shape of the base being a hexagonal as shown in FIG. 2, the bulkheads will intersect the perimeter walls at substantially equally spaced intervals 48. This is beneficial because the lateral loads exerted on the perimeter walls are transmitted substantially equally into proximate bulkheads 24A, 28B.

The triangular 30 and hexagonal 34 chambers may also serve as ballast compartments. Referring to FIGS. 3A, 3B and 3C again, various types of ballast materials such as water 56, rock 58, and sand 60 may be used. As mentioned above, the top plate 44 may be a single continuous plate, or it may be a series of removable plates 44A which contact the top of the bulkheads. In this matter, individual plates 44A may be removed to insert ballast or, alternatively, to insert equipment if the chambers are not to be used as ballast compartments. It is not necessary, however, to remove the top plates to insert ballast. A number of conventional methods are available for inserting ballast with the top plate in place (i.e. pressure injection of ballast material via hoses from the water surface; surface loading of ballast material directly into the chambers prior to submerging, etc.). Such techniques are well known to those skilled in the art.

Similarly, the ballast material may be removed using such conventional techniques as mentioned above, thereby permitting the removal of the base from the ocean floor. In this manner, the base may be retrieved and moved to another location for subsequent use. With a retrievable base, the preferred foundational support would comprise shear plates 38 as opposed to piles 40.

As mentioned above, the bulkheads are continuous throughout the structure. This provides for the uniform and rapid dissemination of loads within the base. It also permits the use of efficient prestressed concrete materials. Preferably, the prestressing technique used would include post-tensioning of the bulkheads once the concrete was poured and set-up. Prestressing techniques are well known to those skilled in the art.

In the present invention, the loads are transmitted into the bulkheads in direct compression. This is an improvement over the circular-oriented bulkheads, as discussed above, because such circular bulkheads transmit the loads through curved members which induce bending as well as compressive loads. If possible, bending loads are to be avoided because they tend to require a fairly stout member to withstand the moments.

The present invention is also an improved offshore base with regards to installation loads. Triangular chambers 30 are a very stable geometric configuration against twisting which may result during the transport of the base to its final location. Typically, these bases are very large (several hundred feet in diameter) and, depending on the sea state, may be supported only at its outer edges or at other intermediate points along its length. Consequently, a twisting or torsional action may result causing substantial loads on the base. An additional advantage of a triangular configuration is that it does not need the added support of top and bottom plates for structural integrity. This is in contrast to a rectangular-shaped bulkhead configuration which is generally dependent on top and bottom plates for stability. In addition, since the bulkheads are continuous in the present invention, they act as beams when the base is supported at its outer edges, by the crest of adjacent waves for example.

A triangular and hexagonal-shaped repeatable grid pattern also minimizes weight. In a radial-oriented bulkhead configuration, the bulkhead spacing is selected to be the proper spacing at the perimeter of the base. Due to the nature of a radial design, the bulkhead spacing decreases towards the interior of the structure, particularly the center. This tends to add excessive weight.

Figure 4:
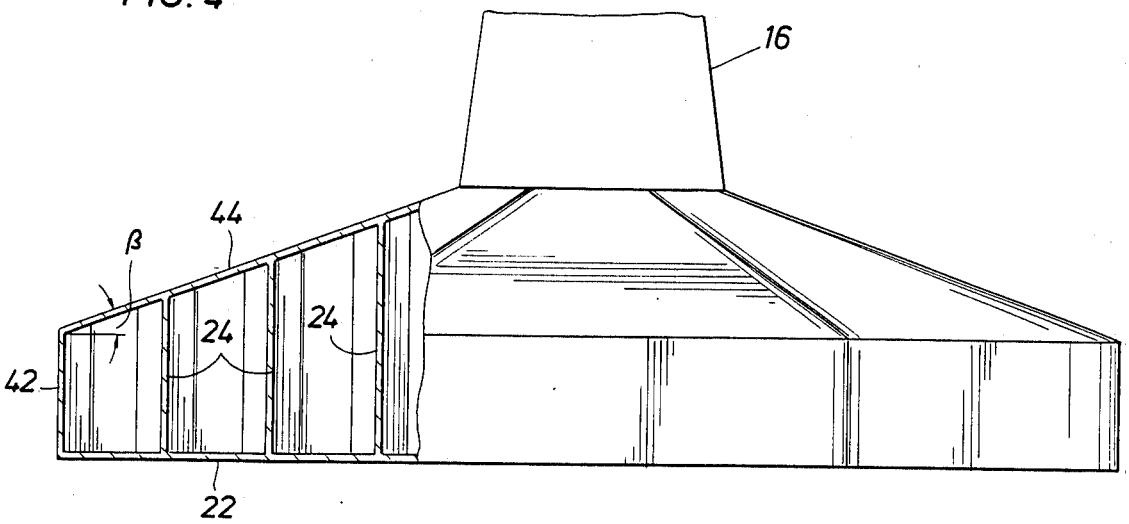
FIG. 4 is an alternate embodiment of the invention.

Referring to FIG. 4, an alternate embodiment is show wherein the top plate 44 may be inclined at an acute angle $\beta$ with respect to the bottom plate 22. This profile slope may be preferable to minimize laterial loads, particularly ice loads. A sloped surface will minimize lateral loads by inducing a bending failure in a contacting ice mass as opposed to a compression failure when a substantially vertical slope is used. Such an alternate embodiment may be used when the operator wishes to minimize the length of the supporting column 16 or eliminate the column altogether. With this profile shape, the interior of the base is similar to that described above with respect to the preferred embodiment. This is, the base includes three sets of continuous, substantially parallel bulkheads intersecting at about 120° to one another. Preferably, the tops of the bulkheads must extend all the way to the top plate.

In either embodiment disclosed, the bulkheads may be made of lightweight prestressed concrete to furthermore minimize the weight. The top and bottom plates may be made of steel. A combination of concrete and steel has been found to be cost efficient and adequately strong.

The present invention has been described in terms of various embodiments. Modifications and alterations to these embodiments will be apparent to those skilled in the art in view of this disclosure. It is, therefore, applicant's intention to cover all such equivalent modifications and variations which fall from the scope and spirit of this invention.

What is claimed is:

1. An improved base for an offshore platform, said base comprising:

a bottom plate contacting the ocean floor;

three sets of continuous, substantially parallel bulkheads, each said bulkhead having a top, bottom and outer edges, said bulkheads being attached along said bottom edge to said bottom plate, the bulkheads of each set intersecting at least a portion of the bulkheads of the other two sets at an angle of about 120° to form a substantially repeatable grid pattern of contiguous triangular and hexagonal-shaped chambers;

top plate means contacting the top edge of said bulkheads; and perimeter wall means attached to said bottom plate and cotacting said top plate means and circumscribing and attached to the outer edges of said three sets of bulkheads so that the outer edges of said bulkheads attach to said perimeter wall means at substantially equally spaced intervals along the length of said wall means.

2. An improved base for an offshore platform, said base comprising:

a bottom plate contacting said ocean floor;

a first set of continuous, substantially parallel bulkheads, attached to said bottom plate means along one edge of said first set of bulkheads;

a second set of continuous, substantially parallel bulkheads attached to said bottom plate means along one edge of said second set of bulkheads and intersecting said first set of bulkheads at about 120°;

a third set of continuous, substantially parallel bulkheads attached to said bottom plate means along one edge of said third set of bulkheads and intersecting said second set of bulkheads at about 120°;

top plate means contacting the opposite edge of said first, second and third sets of bulkheads from said one edge of said first, second and third sets of bulkheads; and perimeter wall means circumscribing and attached to the outer ends of said first, second and third sets of bulkheads and to said bottom plate, wherein said first, second and third sets of bulkheads form an array of contiguous triangular and hexagonal-shaped chambers so that the outer edges of said first, second and third sets of bulkheads attach to said perimeter wall means at substantially equally spaced intervals along the length of said wall means.

3. An improved base for an offshore platform, said base comprising:

a bottom plate contacting the ocean floor;

three sets of continuous, substantially parallel bulkheads, each said bulkhead having a top, bottom and outer edges, said bulkheads being attached along said bottom edge to said bottom plate, the bulkheads of each set intersecting at least a portion of the bulkheads of the other two sets at an angle of about 120° to form a substantially repeatable grid pattern of contiguous triangular and hexagonal-shaped chambers;

a top plate contacting the top edge of said bulkheads wherein said top plate is inclined at an acute angle with respect to said bottom plate; and perimeter wall means attached to said bottom plate and contacting said top plate and circumscribing and attached to the outer edges of said three sets of bulkheads so that the outer edges of said three sets of bulkheads attach to said perimeter wall means at substantially equally spaced intervals along the length of said wall means.

* * * * *